US005967843A

United States Patent [19]

Okabe et al.

[11] Patent Number: 5,967,843

[45] Date of Patent: Oct. 19, 1999

[54] CONNECTOR WITH IMPROVED COVER HINGE CONSTRUCTION

[75] Inventors: Toshiaki Okabe; Satoru Kaneko, both of Shizuoka, Japan

[73] Assignee: Yazaki Corporation, Tokyo, Japan

[21] Appl. No.: 09/056,860

[22] Filed: Apr. 8, 1998

[30] Foreign Application Priority Data

Apr. 8, 1997 [JP] Japan ..... 9-089611

[51] Int. Cl.[6] ..... H01R 13/40

[52] U.S. Cl. ..... 439/596

[58] Field of Search ..... 439/596, 595, 439/701

[56] References Cited

U.S. PATENT DOCUMENTS

| | | | |
|---|---|---|---|
| 5,320,555 | 6/1994 | Okabe | 439/701 |
| 5,618,207 | 4/1997 | Maejima | 439/595 |
| 5,664,967 | 9/1997 | Hatagishi et al. | 439/596 |
| 5,700,163 | 12/1997 | Okabe | 439/596 |
| 5,716,235 | 2/1998 | Endo et al. | 439/596 |
| 5,725,397 | 3/1998 | Fukamachi et al. . | |

FOREIGN PATENT DOCUMENTS 2-41824 7/1990 Japan ..... H01R 13/42

*Primary Examiner*—Steven L. Stephan
*Assistant Examiner*—J. F. Duverne
*Attorney, Agent, or Firm*—Sughrue, Mion, Zinn, Macpeak & Seas, PLLC

[57] ABSTRACT

A connector in which hinges (17), interconnecting a cover (15, 16) and a housing, (11) are positively prevented from being damaged, and the rate of development of defective products during the supply of parts and during the production of a wire harness is reduced. The connector includes a housing (11) having an opening (13) communicating with terminal receiving chambers (12) formed in the housing, a cover 15, 16 for closing the opening (13) and long hinges (17) interconnecting the housing and the cover. Before the cover is closed, the long hinges are deformed in a curved manner, and are received in a space P between the housing and the cover, and connecting bands (18) extend between the housing (11) and the cover, (15, 16) and are disposed outwardly of the long hinges,(17) respectively, and when the cover (15) is to be closed, the connecting bands (18) are cut in parallel relation to a centerline C of the housing, and are removed.

6 Claims, 3 Drawing Sheets

CONNECTOR WITH IMPROVED COVER HINGE CONSTRUCTION

BACKGROUND OF THE INVENTION

This invention relates to a connector suitably used, for example, in a wire harness for an automobile.

A connector of the type described is disclosed in Japanese Utility Model Examined Publication No. 2-41824. As shown in FIGS. 1 and 2, in this connector, a plurality of terminal receiving chambers 2 are formed in a female housing 1, and extend in a forward-rearward direction. Openings 3 are formed in upper and lower surfaces of the housing 1, and communicate with the terminal receiving chambers 2. The openings 3 are closed by covers 4 (each serving also as a terminal retaining member) after press-connecting terminals (not shown), to which wires W are to be connected, respectively, are mounted respectively in the terminal receiving chambers 2. Each of the covers 4 is connected to the upper (or the lower) surface of the housing 1 by a pair of long hinges 5 and 5, and before the cover 4 is closed, each cover 4 is held in a suspended condition above the upper openings 3 (or below the lower openings 3). The pair of upper hinges 5, as well as the pair of lower hinges 5, comprise elastic bands, respectively, which can be easily bent or flexed upon application of an external force.

In the above conventional connector, less time and labor are required for the supply and storage of the parts as compared with the type of connector in which a cover, serving as a terminal retaining member, is separate from a housing. However, in some cases, the parts become entangled with each other during the supply of the parts, and also the wire gets caught in a gap between the housing 1 and the cover 4 (serving also as the terminal retaining member) during the production of a wire harness. This results in a possibility that the hinges 5 are damaged.

SUMMARY OF THE INVENTION

This invention has been made in order to overcome the above problem, and an object of the invention is to provide a connector in which hinges, connecting a cover to a housing, are positively prevented from being damaged, and the rate of development of defective products during the supply of parts and during the production of a wire harness is reduced.

The object can be attained by a connector, according to the present invention, comprising a housing having an opening communicating with terminal receiving chambers formed in the housing; a cover for closing the opening; and long hinges interconnecting the housing and the cover;

wherein when the cover is opened, the long hinges are deformed in a curved manner, and are received in a space between the housing and the cover, and connecting bands extend between the housing and the cover, and are disposed outwardly of the long hinges, respectively, and when the cover is to be closed, the connecting bands are cut in parallel relation to a centerline of the housing, and are removed.

In this connector, the housing is prevented from becoming entangled with another housing during the supply of parts, and besides wires and other parts-are prevented from being caught in a gap between the housing and the cover during the production of a wire harness.

In the above-mentioned connector according to the present invention, advantageously, the connecting bands, interconnecting the housing and the cover, are formed integrally with the housing and the cover, and extend respectively from opposite side portions of the housing respectively to opposite side portions of the cover, and a pair of the long hinges are formed integrally with the housing and the cover, and are disposed between the pair of connecting bands.

In this connector, the pair of long hinges are protected by the pair of connecting bands disposed outwardly respectively of the hinges, and therefore the hinges are positively prevented from being damaged during the supply of the parts and during the production of the wire harness.

In the above-mentioned connector according to the present invention, advantageously, engagement portions are formed respectively on the opposite side portions of the cover, and are disposed adjacent respectively to the pair of connecting bands, and the engagement portions can be respectively brought into and out of engagement with retaining portions formed on the housing.

In this connector, the effect of projecting the pair of long hinges is further enhanced by the pair of connecting bands and the engagement portions provided respectively at the opposite side portions of the cover.

DESCRIPTION OF THE PREFERRED EMBODIMENT OF THE INVENTION

Figure 1:
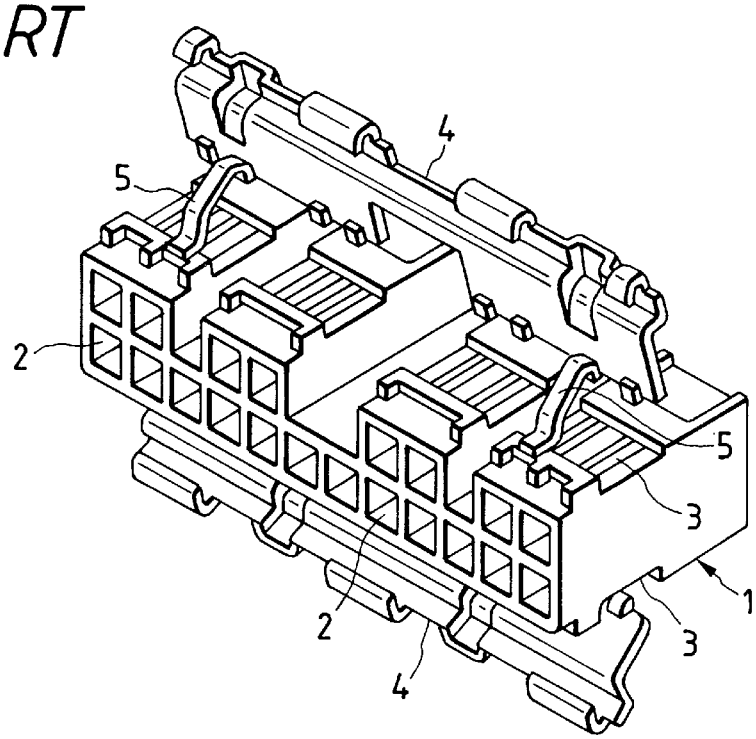
FIG. 1 PRIOR ART
FIG. 1 is a perspective view of a conventional connection, showing a condition before covers are closed.
Figure 2:
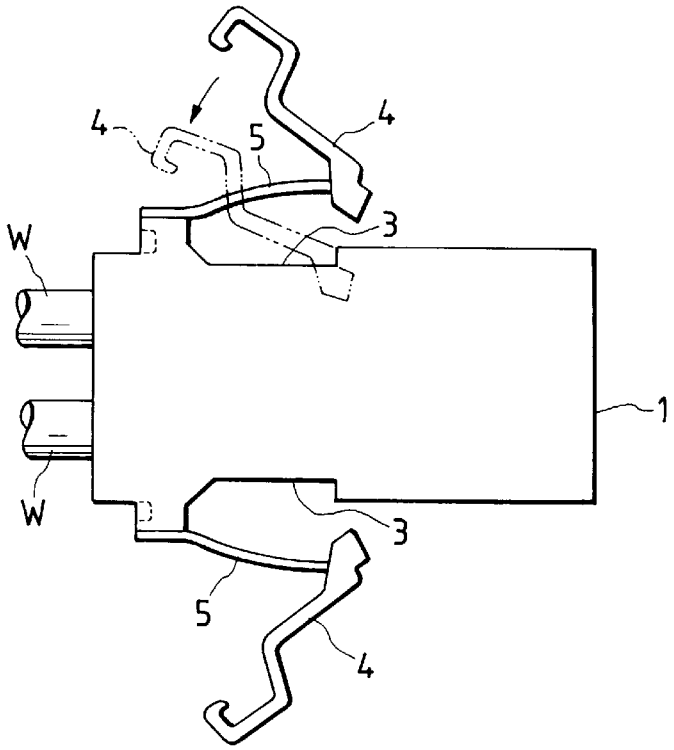
FIG. 2 PRIOR ART
FIG. 2 is a side-elevational view of the conventional connector, showing a condition when the covers are opened (that is, before the covers are closed)
Figure 3:
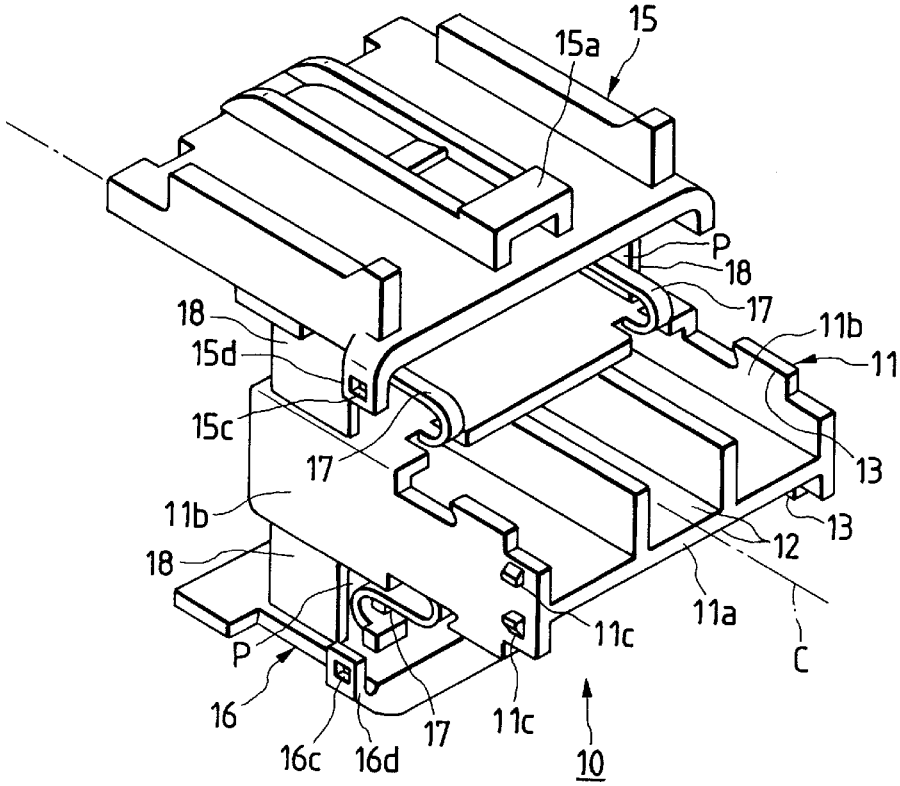
FIG. 3 is a perspective view of one preferred embodiment of a connector of the present invention.
Figure 4:
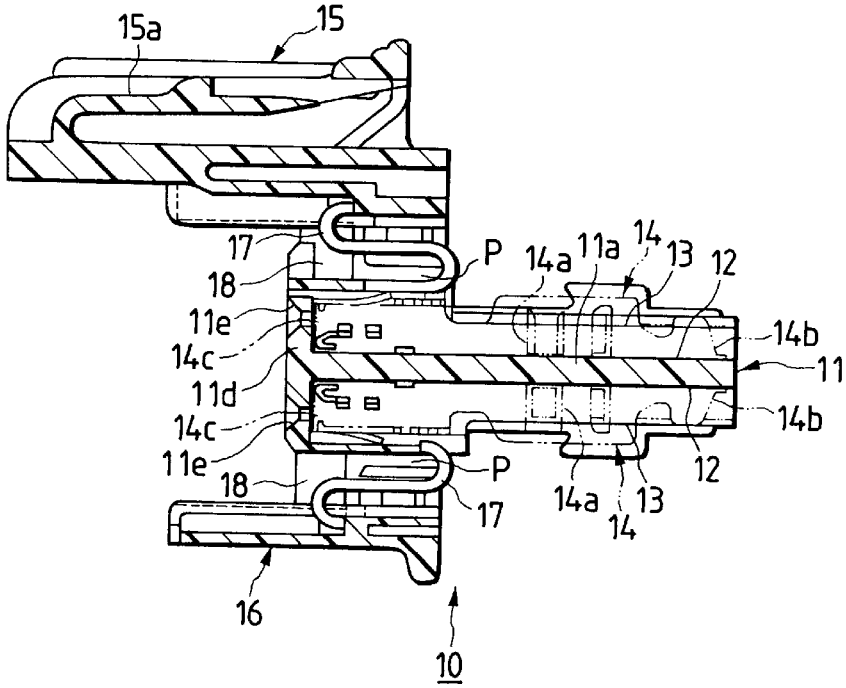
FIG. 4 is a cross-sectional view of the connector, showing a condition before covers are closed.
Figure 5:
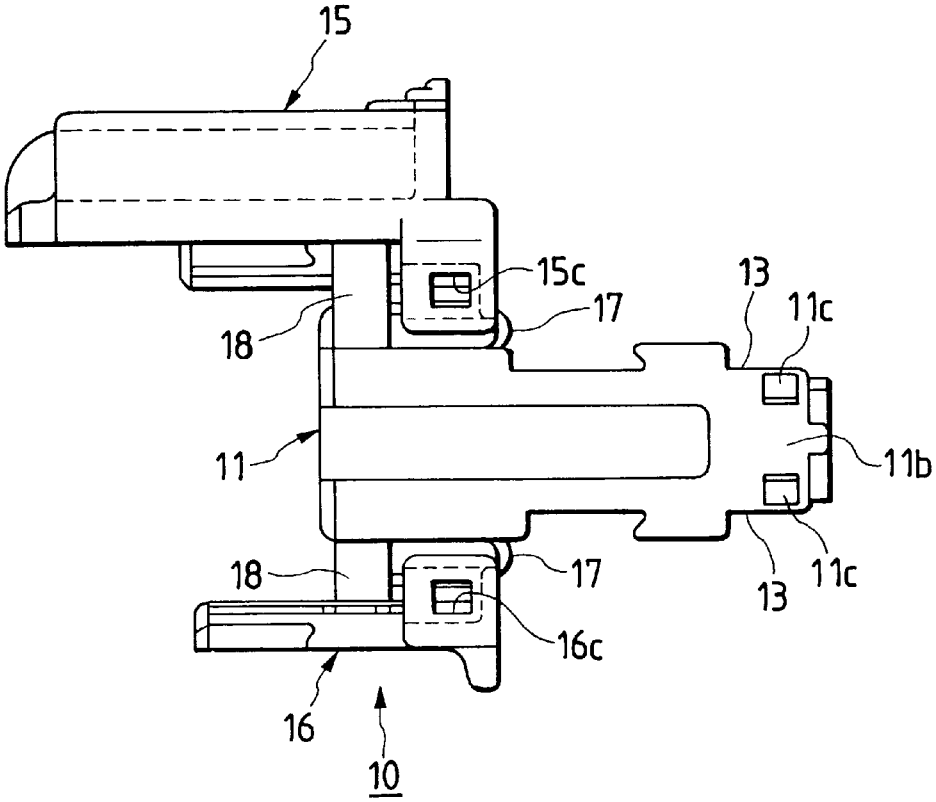
FIG. 5 a side-elevational view of the connector, showing the condition before the covers are set.
Figure 6:
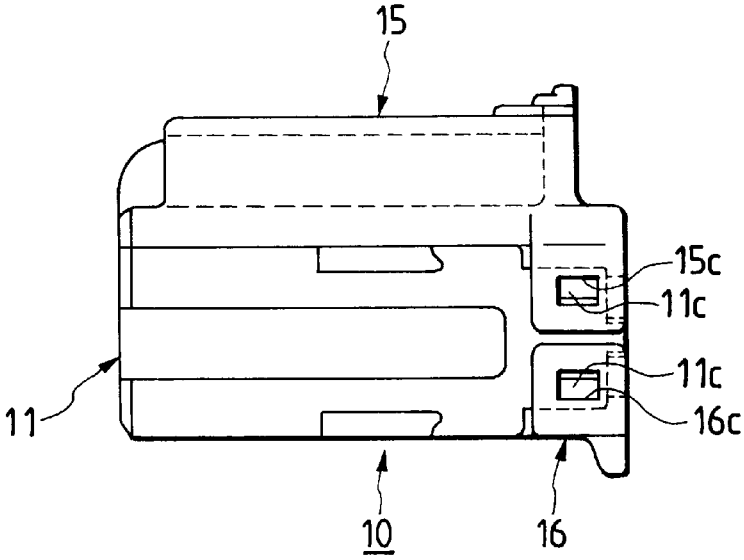
FIG. 6 is a side-elevational view of the connector, showing a condition after the covers are set (that is, the assembling of the connector is completed).

FIG. 3 is a perspective view of one preferred embodiment of a press-connecting connector suitably used, for example, in a wire harness for an automobile, FIG. 4 is a cross-sectional view of the connector, showing a condition before covers are set (that is, during the supply of parts and during the production of a wire harness), FIG. 5 a side-elevational view of the connector, showing the condition before the covers are set, and FIG. 6 is a side-elevational view of the connector, showing a condition after the covers are set (that is, the assembling of the connector is completed).

As shown in FIGS. 3 to 6, the connector 10 comprises a box-shaped housing 11 of a synthetic resin, which includes a plurality of (upper and lower) rows of terminal receiving chambers 12, and a pair of upper and lower openings 13 and 13 formed respectively in upper and lower surfaces of the housing 12 to communicate respectively with the upper and lower rows of terminal receiving chambers 11, a plurality of press-connecting terminals 14 (to which wires (not shown) are to be press-connected, respectively) received respectively in the upper and lower rows of terminal receiving chambers 12 in the housing 11, the pair of upper and lower covers 15 and 16 (which serve also as terminal retaining members, respectively) for respectively closing the upper and lower openings 13 to cover wire press-connecting portions 14*a* and wire clamping portions 14*b* of the press-connecting terminals 14 which are exposed through the openings 13 in the housing 11, a pair of hinges 17 and 17 integrally formed between the housing 11 and each cover 15, 16, and a pair of connecting bands 18 and 18 integrally formed between the housing 11 and each cover 15, 16.

The housing 11 has a central wall 11*a* which is disposed centrally of the thickness of the housing 11, and separates the upper and lower rows of terminal receiving chambers 12 from each other. A pair of upper and lower retaining projections (retaining portions) 11*c* and 11*c* are formed on an outer surface of each of opposite side walls 11*b* and 11*b* of the housing 11 at a rear end portion thereof. As shown in FIG. 4, a plurality of terminal insertion holes 11*e* for respectively passing male terminals of a mating connector (not shown) therethrough are formed through a front wall 11*d* of the housing 11, and are disposed respectively in registry with contact portions 14*c* of the press-connecting terminals 14 received respectively in the upper and lower rows of terminal receiving chambers 12.

Projecting portions 15*d* extend downwardly respectively from opposite side walls of the upper cover 15 at a rear end portion thereof adjacent to the pair of connecting bands 18, and projecting portions 16*d* extend upwardly respectively from opposite side walls of the lower cover 16 at a rear end portion thereof adjacent to the pair of connecting bands 18. Engagement holes 15*c*, 16*c* for being brought respectively into and out of engagement with the associated retaining projections 11*c* formed respectively on the opposite side walls 11*b* and 11*b* of the housing 11 are formed respectively through the projecting portions 15*d*, 16*d*. An L-shaped lock piece portion 15*a* for locking engagement with the mating connector (not shown) is formed integrally on an upper surface of the upper cover 15.

Each pair of hinges 17 and 17 are formed integrally with the housing 11 and the associated cover 15, 16 to interconnect them, and each hinge 17 is in the form of a long, elastically-deformable band. As shown in FIG. 4, before each cover 15, 16 is closed (that is, each cover is opened), each pair of hinges 17 and 17 are deformed in a curved manner, and are received in a space P formed between the upper (lower) surface of the housing 11 and the lower surface of the upper cover 15 (the upper surface of the lower cover 16). Each pair of connecting bands 18 and 18 each in the form of a rectangular plate are formed integrally with the housing 11 and the associated cover 15, 16 to interconnect them, and extend respectively from opposite side portions of the upper (lower) surface of the housing 11 respectively to opposite side portions of the lower surface of the upper cover 15 (the upper surface of the lower cover 16) before each cover 15, 16 is closed. With this construction, each pair of hinges 17 and 17 are disposed inwardly of the associated pair of connecting bands 18 and 18, respectively. When the upper and lower openings 13 in the housing 11 are to be closed respectively by the upper and lower covers 15 and 16, each pair of connecting bands 18 and 18 are cut in parallel relation to a centerline (axis) C of the housing 11, and are removed. Namely, using predetermined means, each connecting band 18 is cut at its upper and lower ends connected respectively to the housing 11 and the cover 15, 16, and is removed.

In the connector 10 of the above embodiment, before each cover 15, 16 is closed, each pair of long hinges 17 and 17 are deformed in a curved manner, and are received in the space P between the housing 11 and the cover 15, 16, and besides each pair of connecting bands 18 and 18 are formed integrally with the housing 11 and the associated cover 15, 16, and extend respectively from the opposite side portions of the housing 11 respectively to the opposite side portions of the cover 15, 16. Therefore, each pair of hinges 17 and. 17 are positively protected by the associated pair of connecting bands 18 and 18, disposed outwardly respectively of the hinges 17 and 17, and the projecting portions 15*d*, 16*d* each having the engagement hole 15*c*, 16*c*, thereby achieving an enhanced hinge projection effect, and besides the housing 11 is positively prevented from becoming entangled with another housing 11, and furthermore the wires or other parts are positively prevented from being caught in a gap between the housing 11 and the cover 15, 16 during the production of the wire harness. Therefore, during the supply of the parts and during the production of the wire harness, the hinges are positively prevented from being damaged, thereby reducing the rate of development of defective products.

When assembling the connector 10, each of the connecting bands 18 is cut at its opposite ends connected respectively to the housing 1 and the cover 15, 16, using the predetermined means. The pair of upper and lower covers 15 and 16 are moved respectively toward the upper and lower openings 13 and 13 in the housing 11 in parallel relation thereto through the hinges 17 and 17 to thereby close the same, thus completing the assembling operation as shown in FIG. 6.

Although the above embodiment is directed to the press-connecting connector having the plurality of (upper and lower) rows of terminal receiving chambers, the invention can be applied to a combined-type connector in which a plurality of housings each having a plurality of terminal receiving chambers are stacked together.

As described above, in the connector of the invention, the housing is prevented from becoming entangled with another housing during the supply of parts, and besides wires and other parts are prevented from being caught in a gap between the housing and the cover during the production of a wire harness.

In addition, in the connector of the invention, the pair of long hinges are protected by the pair of connecting bands disposed outwardly respectively of the hinges, and therefore the hinges are positively prevented from being damaged during the supply of the parts and during the production of the wire harness, thereby reducing the rate of development of the defective products.

Further, in the connector of the invention, the effect of projecting the pair of long hinges is further enhanced by the pair of connecting bands and the engagement portions provided respectively at the opposite side portions of the cover.

What is claimed is:

1. A connector comprising:

a housing having an opening communicating with terminal receiving chambers formed in said housing;

a cover for closing said opening; and hinges interconnecting said housing and said cover, said hinges being deformed in a curved manner and received in a space defined between said housing and said cover when said cover is opened; and connecting bands extending between said housing and said cover and being disposed laterally outwardly of said hinges, respectively, so as to protect said hinges from an external force wherein when said cover is to be closed, said connecting bands are cut.

2. The connector according to claim 1, wherein when said cover is to be closed, said connecting bands are cut in parallel relation to a longitudinal centerline of said housing, and are removed.

3. A connector comprising:

a housing having an opening communicating with terminal receiving chambers formed in said housing;

a cover for closing said opening; and hinges interconnecting said housing and said cover, said hinge being deformed in a curved manner and received in a space defined between said housing and said cover when said cover is opened; and connecting bands extending between said housing and said cover and being disposed outwardly of said hinges, respectively, wherein when said cover is to be closed, said connecting bands are cut, and wherein said connecting bands are formed integrally with said housing and said cover, and a pair of said hinges are formed integrally with said housing and said cover so as to be disposed between said pair of connecting bands.

4. A connector comprising:

a housing having an opening communicating with terminal receiving chambers formed in said housing;

a cover for closing said opening; and hinges interconnecting said housing and said cover, said hinge being deformed in a curved manner and received in a space defined between said housing and said cover when said cover is opened; and connecting bands extending between said housing and said cover and being disposed outwardly of said hinges, respectively, wherein when said cover is to be closed, said connecting bands are cut, and wherein said connecting bands are formed integrally with said housing and said cover, and a pair of said hinges are formed integrally with said housing and said cover so as to be disposed between said pair of connecting bands.

5. The connector according to claim 3, wherein said housing is provided with a pair of retaining portions at position away from said connecting bands respectively, and said cover is provided with a pair of engagement portions which are respectively disposed at positions adjacent to said pair of connecting bands and are brought in engagement with said pair of retaining portions respectively when said cover is closed.

6. The connector according to claim 4, wherein said housing is provided with a pair of retaining portions at position away from said connecting bands respectively, and said cover is provided with a pair of engagement portions which are respectively disposed at positions adjacent to said pair of connecting bands and are brought in engagement with said pair of retaining portions respectively when said cover is closed.

* * * * *